FIG. 9.
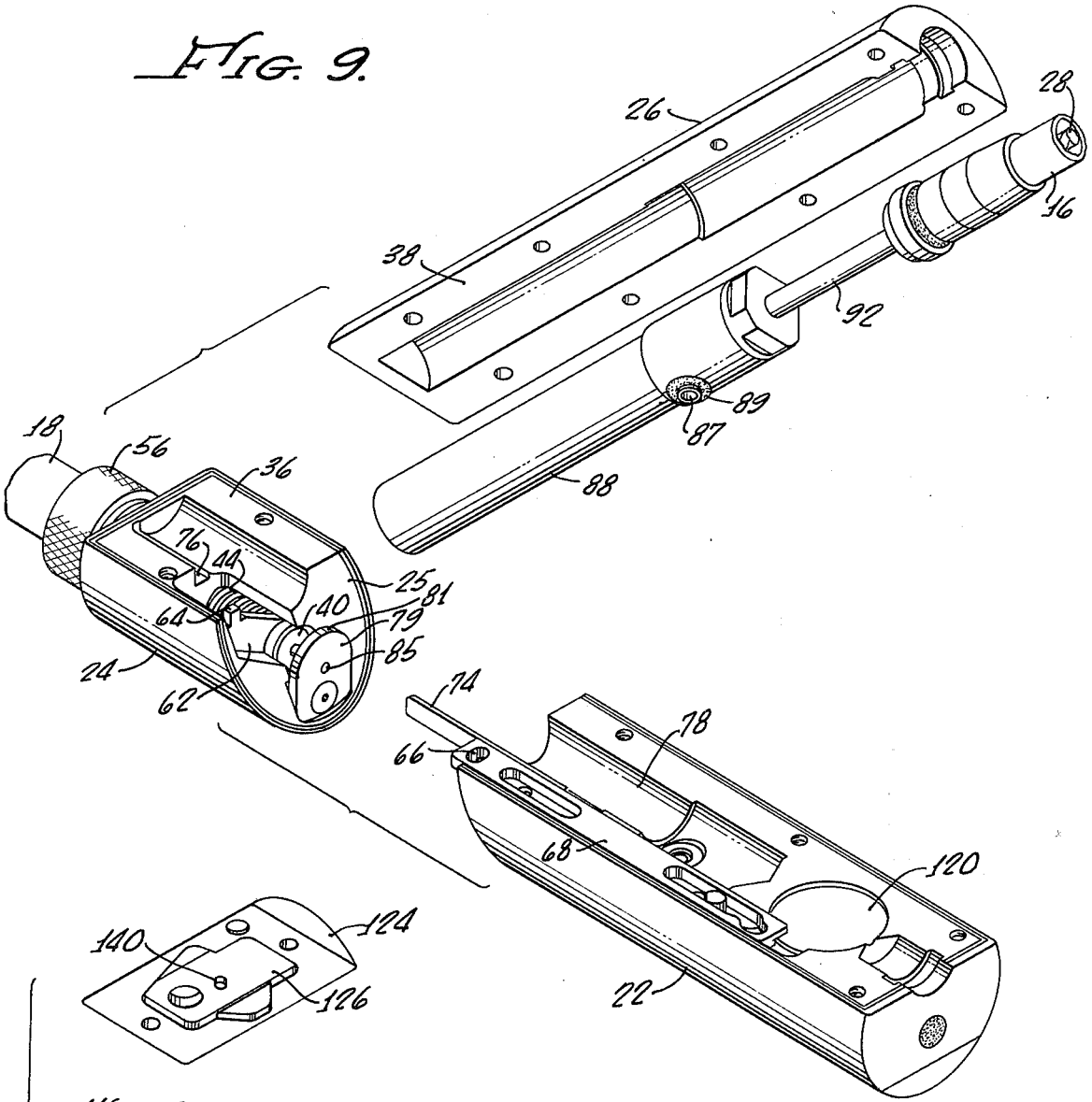
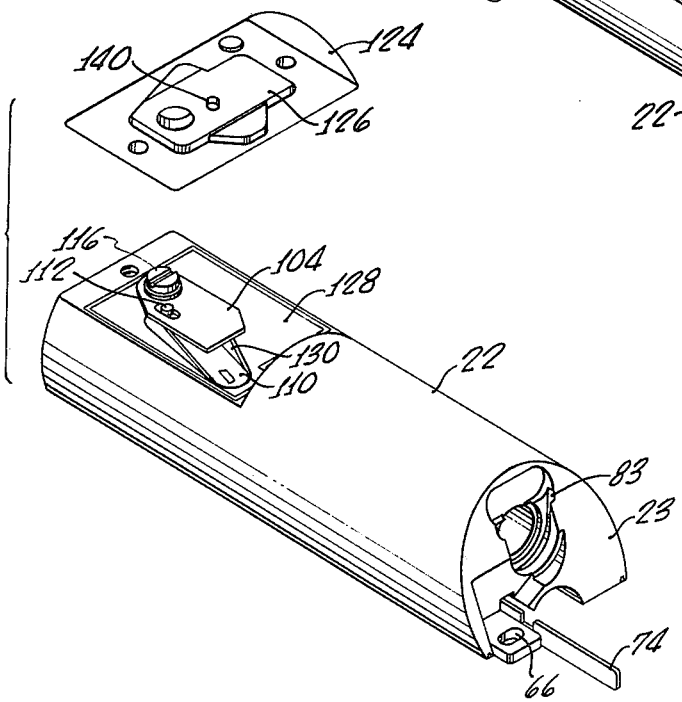
FIG. 10.

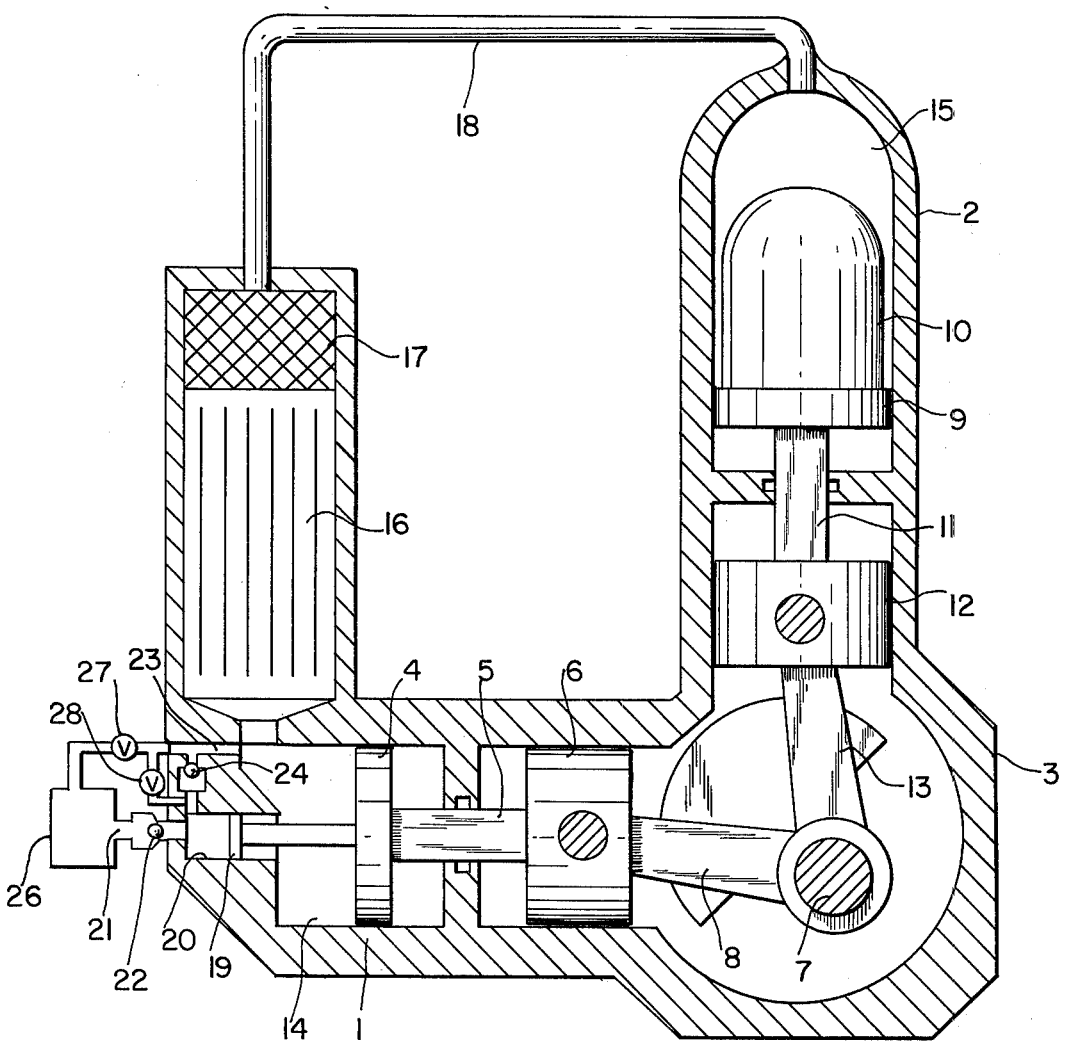
18
15
2
10
9
17
16
11
12
27
23
28
4
5
6
24
13
3
26
21
22
20
19
14
1
8
7

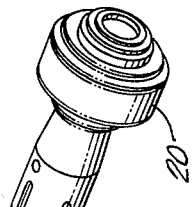
20

CONTROLLED ACTUATOR

BACKGROUND OF THE INVENTION

The present invention relates to controlled actuator mechanisms and more particularly concerns simplified and improved control of such mechanisms.

Controlled actuator mechanisms are used in a number of different applications and are particularly useful in aircraft for initiating various types of emergency operations. Commonly, explosive charges are employed to perform emergency functions with maximum certainty and minimum delay. Thus, upon occurrence of an emergency, detonation of an explosive charge is initiated by a controlled actuator mechanism and emergency procedures such as removal of a canopy of a pilot's compartment, ejection of a pilot's seat with the pilot therein, release of restraints holding the pilot to the seat and release and deployment of a parachute for recovery of the ejected pilot are carried out. Certain of these mechanisms are mounted directly upon the parachute and may be hand operated or operated, after suitable delay, by ejection of the pilot from the aircraft.

In many of these operations, and in particular for release and deployment of the parachute, it is necessary that the desired emergency action such as deployment of the parachute, does not occur unless the pilot and his parachute are below a predetermined altitude. This is so even though the command to accomplish the emergency procedures occurs at a considerably earlier time (and at a higher altitude). Accordingly, actuators of this type must be controlled by a command, which commonly occurs when emergency procedure is desired to be initiated, and in addition, by a pressure sensitive device.

It will be understood that emergency initiators and actuators of the type under discussion, are generally used but one time. Nevertheless, they are carried about for long periods of time and for such long periods must be in continued state of readiness. This long inactive period of constant readiness considerably intensifies inherent problems.

In some prior art mechanisms, a cartridge is fired by a firing pin that is powered by a stressed spring and retained by an aneroid cell. The device is assembled in cocked position and thus additional safety devices must be provided to prevent premature firing of the explosive cartridge. Even with the use of such safety devices, the continual presence in an aircraft of a cocked or armed explosive device is highly undesirable.

In those devices of the prior art that are barometrically controlled, the sensitive pressure responsive aneroid generally is directly connected to a trigger mechanism as by a pin connection or the like. This connection imposes a continuous load upon and restraint against the ordinary motion of the sensitive pressure instrument. Continual motion of the aneroid device as it is carried about through varying ambient pressures causes repetitive motion of devices connected thereto. This long period of continued motion of interconnected elements of trigger mechanisms is not desirable and may significantly degrade reliability.

One solution to the danger of a pre-cocked explosive initiator is suggested in U.S. Patent to Roberts et al U.S. Pat. No. 3,142,958, wherein a parachute release mechanism is operated by the firing of an explosive charge. Detonation of the charge is initiated by a firing mechanism that is cocked or armed as an incident to the generation of power in a pilot's seat ejector mechanism. When the seat ejection mechanism is actuated, power is supplied to the parachute release initiator to move a firing pin and a hammer against the action of a firing spring into a cocked position. As the firing pin and hammer are moved to the cocked position in this arrangement an aneroid controlled sear pin is pivoted and the hammer is thereby moved into engagement with the sear pin. The sear pin is held until the aneroid operates the trigger mechanism to release restraint on the sear and allow the hammer and firing pin to be driven under the action of the compressed spring. In the arrangement of this patent, the aneroid control element is at all times connected to the sear restraining trigger and consequently the trigger mechanism is continually moving throughout the inactive life of the device. Further, cocking of the device requires a relatively complex interaction and motion of the sear and hammer since the latter is no way connected with the sear pin prior to cocking, and the sear must be pivoted in the one direction to permit the hammer to move into its restraining engagement with the sear. Motion of the sear in the opposite direction is then required for release of the hammer for firing. The arrangment of Roberts et al, does not facilitate a compact minimum volume package with the barometer in line with the firing pin. Thus, size and weight of the device are undesirably increased.

A parachute actuator is shown in the patent to Hallerberg, U.S. Pat. No. 2,953,063 wherein a leaf spring drives a firing pin having a secondary control from an aneroid device via a system of levers pivoted to and between the hammer and to the aneroid device. A major drawback of the arrangement of Hallerberg is the fact that the firing spring and hammer must be precocked so that the firing spring is always stressed and the aircraft is required to continuously carry an armed and cocked explosive device. Not only is the device of Hallerberg always cocked or armed, but the aneroid is directly connected at all times to the lever system and thus this system of levers must move whenever the aneroid experiences variations in ambient pressure.

In a copending application of F. X. Chevrier et al for Controlled Actuator, Ser. No. 491,733, filed July 25, 1974, there is described an aneroid actuated explosive initiator which is cocked in response to a relatively high pressure generated by an emergency device. The actuator of the co-pending application Ser. No. 491,733 is operable under high pressure, in the order of 400 pounds per square inch, for example, and embodies a spring driven rotatable sear for restraining the cocked hammer in response to ambient pressure. Relatively large cocking forces and unique packaging requirements are involved. At least in part because of the smaller forces required for operation of a parachute rip cord release, a simpler and more directly operable mechanism and aneroid controlled sear configuration can be used and are desirable.

Accordingly, it is an object ot the present invention to provide a controlled actuator that eliminates or minimizes the above-mentioned disadvantages and achieves efficient, safe, reliable and precision operation in a compact package of small size and weight.

SUMMARY OF THE INVENTION

In carrying out principles of the present invention, in accordance with a preferred embodiment thereof, a pressure sensitive device is provided for control of a spring driven hammer of an actuator. A movably mounted sear is connected to the hammer to move with the hammer as it is cocked, and trigger means are interposed between the pressure sensitive device and the sear to restrain the sear and thereby restrain the hammer under control of the pressure sensitive device. According to a feature of the invention, the sear is connected to move together with the hammer and to cause the trigger mechanism to move from an inactive position to an active position as the hammer is cocked. In its active position, the trigger mechanism is controlled by the pressure sensitive device whereas in its inactive position, prior to cocking of the hammer, the trigger mechanism is held out of operative engagement with the pressure sensitive device. According to another feature of the invention, compact packaging is provided by mounting a cartridge chamber of a device between the hammer and its drive spring at one end and the pressure sensitive device and trigger mechanism at another end, with a slidably mounted elongated sear extending along the cartridge chamber and connected to and between the hammer at one end and the trigger mechanism at the other end. A cam follower and cam slot connection are provided between the sear and the trigger mechanism to move the trigger mechanism into operative position upon cocking of the hammer and to restrain motion of the sear and accordingly of the hammer under control of the pressure sensitive mechanism when the hammer is cocked.

BRIEF DESCRIPTION OF THE DRAWINGS

FIG. 1 shows a packed parachute having an explosive initiator of the present invention mounted thereon;

FIG. 2 is a perspective drawing of a preferred form of the initiator of the present invention;

FIG. 9 is an exploded perspective view of the mechanism of FIG. 2, showing the actuator piston and its housing section tilted upwardly;

FIG. 10 is an exploded perspective view of the sear, aneroid and trigger housing section with the trigger cover tilted upwardly to show its trigger recesses;

DETAILED DESCRIPTION

Figure 4:
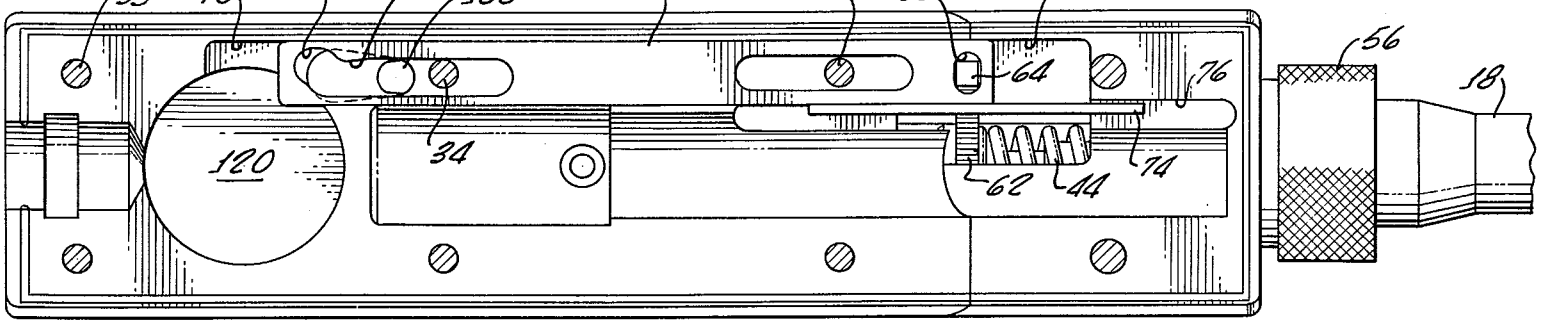
FIG. 4 is a section taken on lines 4—4 of FIG. 3.

Mechanism embodying principles of the present invention will find wide application in a variety of situations where a function is to be performed by a driven member that is caused to move under control of one or more controlling conditions or commands. In a specific application, the invention provides reliable and efficient initiation of an explosive device in response to the occurrence of at least two conditions. The first of the conditions is a command which arms or cocks the device. The second is a response to an automatically measured condition such as pressure, for example, that allows the device to be actuated when or after it has been cocked.

The invention has been initially embodied in an aneroid actuated explosive initiator for a manually or ejection operated parachute rip cord release, and a preferred embodiment adapted for such funtion is disclosed herein.

Illustrated in FIG. 1 is a conventional parachute 10 having a release cable or rip cord 12 which is to be pulled upwardly when it is desired to deploy the parachute. According to the present invention, a controlled actuator or explosive initiator 14 is attached to the parachute and connected to rip cord 12 by means of a tension member carried in a flexible sheath 16. An actuator operating cable is carried in a second flexible sheath 18 and connected between the initiator 14 and an operating handle or knob 20 that is carried on the parachute in a position to be conveniently grasped by the person wearing the parachute. In some situations, a second rip cord pulling device (not shown) may be attached to the rip cord 12 and connected to a suitable operating mechanism or be adapted for alternative manual operation. It will be readily understood that the operating handle or mechanism of the described initiator 14 may be connected to structure fixed in the aircraft, such as a pilot's seat or a seat support structure, so that upon leaving the seat or upon ejection of the seat from the aircraft, operation of the initiator 14 is automatically commanded. The initiator 14 embodies a conventional explosive cartridge having a built-in delay so that the actual pulling of the rip cord will take place after the command for operation of the initiator.

As will be more particularly described below, the initiator 14 also includes a pressure sensitive control that prevents detonation above a preselected altitude. Thus, even though operation of the initiator is commanded, as by separation from the seat or aircraft or by pulling of the knob 20, rip cord 12 will not be pulled and parachute deployment will not occur until the parachute and its wearer descend below a predetermined altitude. On the other hand, if deployment of the parachute should be commanded as by pulling knob 20, for example, when the parachute is already below such predetermined altitude, the deployment will take place and the rip cord 12 will be pulled immediately after the time delay built into the explosive cartridge of the initiator.

As illustrated in FIG. 2, initiator 10 includes a first housing section 22 carrying a cartridge chamber and cartridge, a sear, a pressure control device and a trigger mechanism. A second housing section 24 carries a cartridge detonation hammer and firing pin together with a driving spring. A third housing section 26 spans the length of the two sections 22 and 24 and contains an actuator cylinder and piston. The piston is connected to a rip cord pulling cable 28 mounted in the flexible cable sheath 16 and connected by means of a fitting 30 to the rip cord 12 (FIG. 1). The device is cocked and thereupon actuated or operated under control of the pressure sensitive aneroid by pulling on a cable 32 carried in the flexible sheath 18 and fixed to the knob 20 at one end and to the hammer cocking mechanism at the other. The three housing sections 22, 24 and 26 are securely but detachably connected to each other in the configuration illustrated in FIG. 2 by means of a plurality of screws such as those indicated at 33, 34 and 35.

Referring now to FIGS. 3, 4, 5, 6, 9 and 10, housing section 24 is of generally cylindrical configuration having a flat surface 36 (FIG. 9) that mates with a corresponding flat surface 38 of the housing section 26. Section 24 is bored to receive a hammer having a head 40 fixed to a hammer shaft 42 upon which is mounted a coil spring 44 that is arranged to be compressed between the head of the hammer and an outer flange 46 of a sleeve 48 having a bore that snugly and slidably receives the hammer shaft 42.

Hammer shaft 42 is releasably connected to a cocking pin 50 by means of interengaging cams 52, 54 formed on the end of hammer shaft 42 and the cocking pin 50, respectively. The interengaging cams 52 and 54 are held in operative interconnected relation when they are in the position illustrated in FIG. 3 wherein both cams 52 and 54 are received in a snug sliding fit within the bore of sleeve 48.

Cocking pin 50 is fixedly connected to the end of operating cable 32 within an enlarged end of flexible housing or sheath 18 which is fixed to initiator housing section 24 by means of a cap 56 threadedly engaged upon an end of housing section 24 and having inwardly directed flanges 58 overlying outwardly directed flanges 60 formed at the end of flexible cable housing 18.

Hammer head 40 has fixedly secured thereto a radially outwardly extending sear driving arm 62 having a projecting tongue 64 that extends into a hole 66 formed in one end of an elongated slidable sear plate 68 (FIG. 4).

Sear plate 68 comprises a rigid, flat plate of substantially rectangular cross section that is slidably mounted in an elongated slot 70 formed in housing section 22. Housing section 24 is formed with a recess 72 that allows motion of sear driving arm 62 axially of the housing as the hammer is moved to and from cocked position. A rigid guide bar 74 (FIGS. 4, 6) is fixed to one end of the sear plate 68 and projects beyond the end of the sear plate and downwardly therefrom toward the hammer for sliding engagement with a guide surface 76 formed in the housing section 24.

A cartridge chamber 78 is formed in housing section 22 and carries a cartridge 80 that is to be detonated by a firing pin 84 fixed to the head 40 of the hammer. Housing section 24 has an inclined face 25 that mates with a correspondingly inclined face 23 on housing section 22. Section 24 fixedly carries a breech plate 79 (FIG. 9) lying in a plane extending radially of the initiator and having a semi-circular end 81 that is a snug sliding fit within a semi-circular groove 83 of housing section 22. This allows housing sections 22 and 24 to be readily interfitted with each other, with breech plate 79 closing the end of the cartridge chamber and cooperating with groove 83 and housing section 26 to resist the forces of cartridge detonation. An aperture 85 in breech plate 79 allows the firing pin 84 to operatively contact a cartridge in the chamber.

Cartridge 80 is preferably of the type having a builtin delay so that pressurized gases of detonation are generated only at the end of a predetermined delay after the cartridge is struck by the firing pin. Pressurized gases of detonation are fed from one end 86 of the cartridge chamber via a conduit 87, sealed by O-rings 89, to the interior of an actuating cylinder 88 that is snugly carried in a cylindrical recess cooperatively formed between housing section 26 on the one hand and both of the housing sections 22 and 24 on the other (FIG. 9). Mounted within the cylinder 88 is an actuator piston 90 having a piston shaft 92 fixedly connected to one end of the operating cable 28 in sheath 16. Actuator cylinder 88 is closed at one end thereof (the left end as viewed in FIG. 3) by a threaded cap 94 suitably sealing the actuating chamber formed between the cap and one side of the piston 90. Cylinder 88, piston 90, including piston rod 92 and cylinder cap 94 form a unitary subassembly together with actuator cable 28 and housing 16 which are readily inserted into the cylindrical recess defined by housing sections 26, 22 and 24.

Sear plate 68 is formed with a cam slot 96 at the left end thereof (as viewed in FIG. 4). Cam slot 96 has an outwardly angulated end portion 98 that enables the trigger mechanism to restrain motion of the sear from cocked position as will be described below. Received within the slot 96 is a depending cam pin 100 of a trigger mechanism comprising first and second interconnected levers 102 and 104 (see FIGS. 7, 8 and 10 – 13). Lever 102 includes a journalled shaft 106 (FIGS. 11 – 13), mounted in housing section 22 for pivotal motion about an axis substantially perpendicular to the direction of slidable motion of the sear and the axis of the cartridge and hammer shaft. Lever 102 includes a first arm 108 affixed to the shaft 106 and carrying cam pin 100 and a second arm 110 detachably connected to the shaft 106 but connected for rotation therewith by means of a rectangular slot in the arm which receives a mating rectangular extension 111 on the end of the shaft. Arm 110 fixedly carries in interconnecting pin 112 that extends into an elongated slot 114 formed in the body of lever 104. Lever 104 is mounted for pivotal motion (about an axis parallel to the axis of first lever shaft 106) upon the shank of a screw 116 that is threaded into housing section 22.

The end of housing section 22 (at the left side as viewed in FIG. 3) is formed with a radially extending circular cylindrical chamber 118 that receives a conventional aneroid mechanism 120 having an aneroid control pin 122 connected to move axially in a direction parallel to the axis of lever shaft 106 and parallel to lever pivot 116 as ambient pressure varies to cause expansion and contraction of the aneroid device. Housing section 22 is recessed at its lower side as viewed in FIG. 3 and cooperates with a trigger mechanism cover plate 124 and a mating recess 126 formed therein to provide an interior chamber permitting motion of the levers of the trigger mechanism. More specifically, housing section 22 includes a portion 128 defining an end wall of the aneroid receiving chamber. This end wall is apertured to receive the aneroid control pin 122 which projects therethrough. The end wall is further recessed as indicated at 130 (FIGS. 7 and 10) to allow motion of arm 110 of the primary lever 102. The latter is notched as indicated at 132 (FIG. 8) to allow for motion of the primary lever to its active position as will be more particularly described hereinafter. Secondary lever 104 moves primarily through the recess 126 formed in the inside of the trigger mechanism cover 124. A window 135 is provided to enable visual monitoring of the position of the aneroid 120. Window 135 comprises a transparent element that seals a viewing passage extending through the housing 22 into the aneroid receiving chamber 118. Cover 124 is detachably connected to housing section 22 by means of screws 136 and 137. A passage 139 extends through the end of housing section 22 to connect aneroid chamber 118 to ambient pressure.

Mounted in cylindrical recess 140 formed in cover 124 is a pin 142 resiliently urged toward secondary lever 104 by a spring 144. Secondary lever 104 is mounted upon its journal 116 in a floating relation for a limited amount of motion in a direction parallel to the axis of its pivotal mounting. Accordingly, as the aneroid control pin 122 moves in and out relative to the aneroid body under varying ambient pressure, the secondary lever 104 will move together with the pin 122 and will maintain contact of its underside with the end surface of pin 122. The force exerted by spring 144 is sufficient to maintain the secondary lever 104 in contact with the end of the aneroid pin 122 but does not exert a force great enough to significantly interfere with the pressure responsive motion of the pin.

OPERATION

Figure 3:
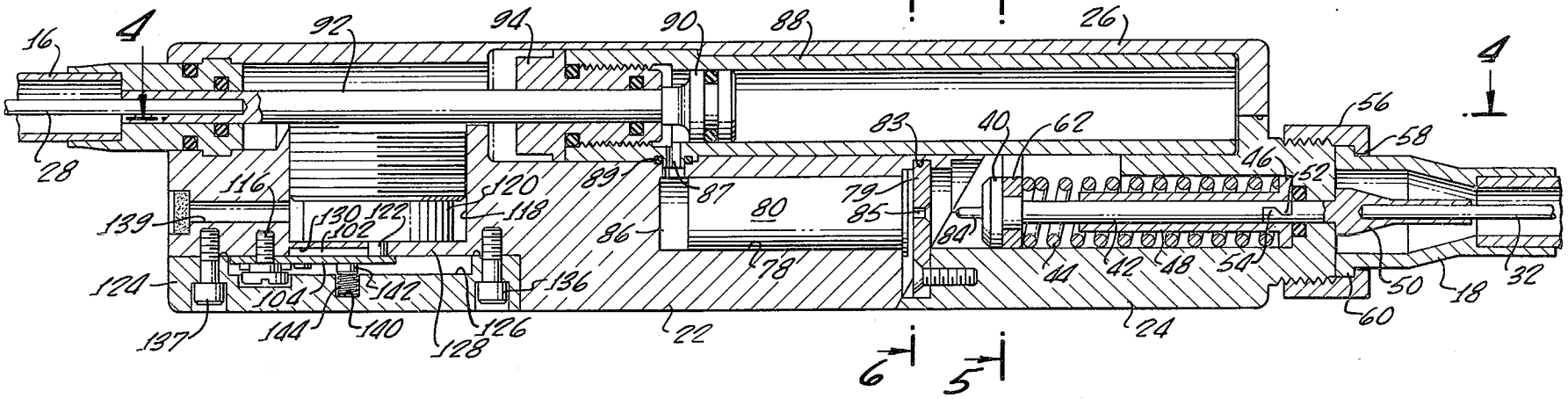
FIG. 3 is a section taken on lines 3—3 of FIG. 2.
Figure 5:
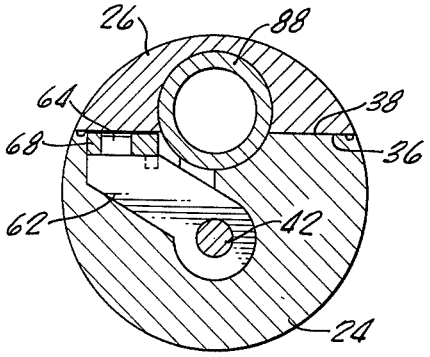
FIGS. 5 and 6 are sections taken on lines 5—5 and 6—6, respectively of FIG. 3.
Figure 6:
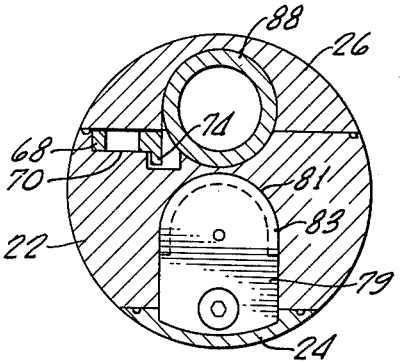
Figure 11:
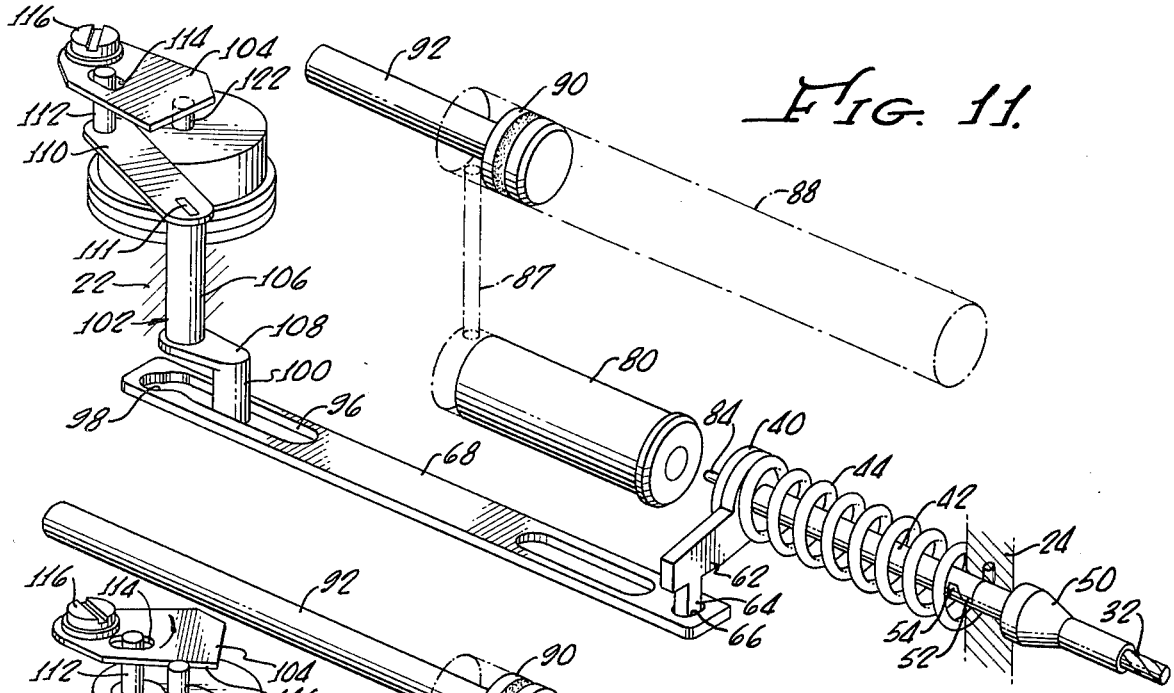
FIG. 11 is a schematic illustration of components of the preferred embodiment of the invention showing the mechanism in precocked position.
Figure 12:
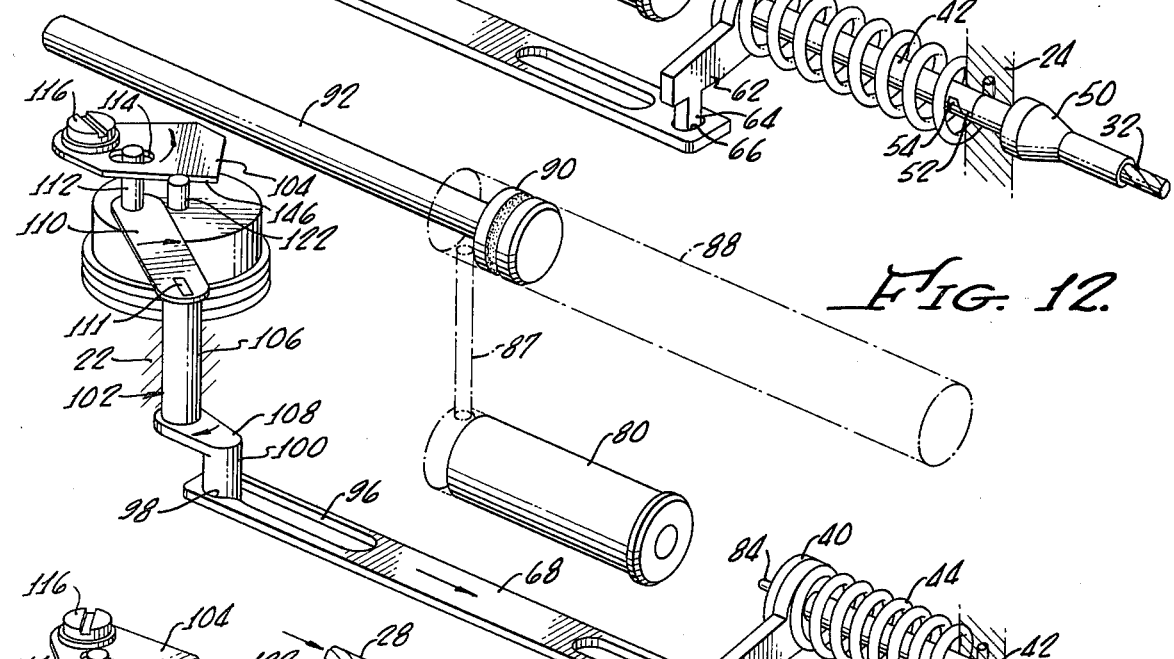
FIG. 12 is a scehmatic illustration of the mechanism in cocked position.
Figure 13:
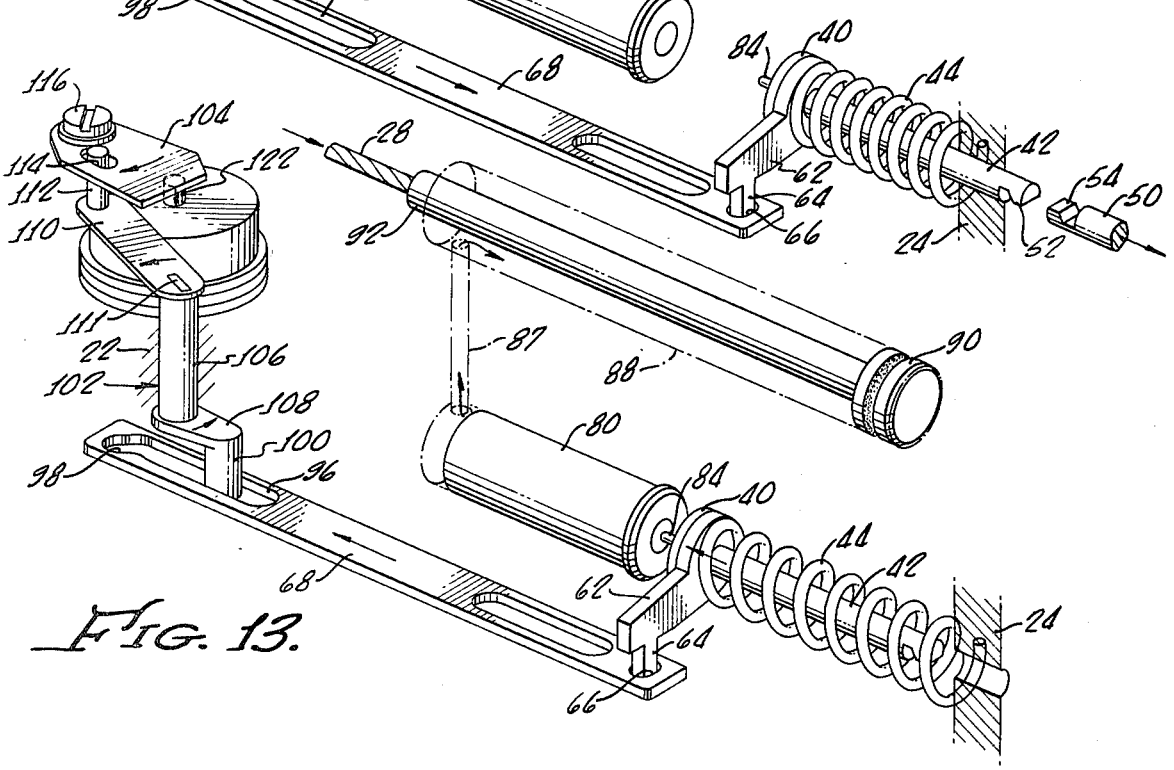
FIG. 13 is a schematic illustration of the mechanism after cartridge detonation and actuation.

FIGS. 11, 12 and 13 are schematic illustrations of major operating components of the above described initiator in three different positions thereof. The first position, shown in FIG. 11, is a precocked position in which apparatus is normally carried prior to being called upon for operation. FIG. 12 shows the position of the parts after the initiator has been cocked by pulling upon the cable 32, showing the restraint exercised by the aneroid device above its preselected altitude. FIG. 13 shows the arrangement of parts after the device has been cocked and has descended below the predetermined altitude of the aneroid control. As shown in FIG. 11, the device is initially assembled in a precocked condition (also shown in FIGS. 3 –7) with the hammer 40 withdrawn slightly from its detonating position (FIG. 13) and spring 44 under a slight compression. Interengaging cams 52, 54 of hammer shaft 42 and cocking pin 50 are held in the mutually interlocked position because they are confined within the bore of sleeve 48 (FIG. 3). Forward motion of the hammer (toward the left in these figures) is resisted by engagement of the cocking pin 50 with the end surface of housing section 24 as can be best seen in FIG. 3. Cartridge 80 is in place within the chamber and actuator piston 90 is near the left most end of actuator cylinder 88. Passage 87 provides fluid communication between cylinder 88 (to the left of piston 90) and the left most end of the cartridge chamber. Sear aperture 66 at all times engages and receives the projecting tongue 64 of sear drive arm 62. Thus, sear plate 68 is in its precocked position as shown in FIG. 11.

Cam pin 100 is freely received within an intermediate portion of cam slot 96 and the trigger mechanism is in inactive position in which lever 102 is rotated relatively counter-clockwise (as viewed from the upper end of shaft 106 in FIG. 11) with respect to the active position shown in FIG. 12. With the primary lever 102 in its inactive relatively counter-clockwise position, secondary lever 104 is also in its inactive position which is displaced relatively clockwise with respect to its active position. In such inactive position, secondary lever 104 overlies the end of aneroid actuator pin 122 and is lightly pressed downwardly (as viewed in FIG. 11) against the upper end of the aneroid pin. Lever 104 is mounted with a small degree of motion axially of its pivot and is held against the aneroid pin by means of the spring urged pin 142 mounted in cover 124 (FIG. 3). In the inactive condition, the aneroid may expand or contract and its pin 122 may move axially against the secondary lever 104 which lies in the path of motion of the pin 122. Nevertheless the lever 104, in its inactive position, exerts negligible restraint upon motion of the aneroid pin. The entire trigger mechanism and aneroid are in an inactive position with respect to the sear and hammer. The latter are in no way restrained by the aneroid or trigger mechanism. Lever arm 110 is actually mounted close to lever 104. Slot 130 in housing section 22 has a depth slighly greater than the thickness of arm 110, and slot 126 of cover 124 has a depth sufficient to permit the floating of lever 104. The axial displacement of lever 104 and arm 110 is exaggerated in FIGS. 11, 12 and 13 for clarity of illustration only.

Figure 7:
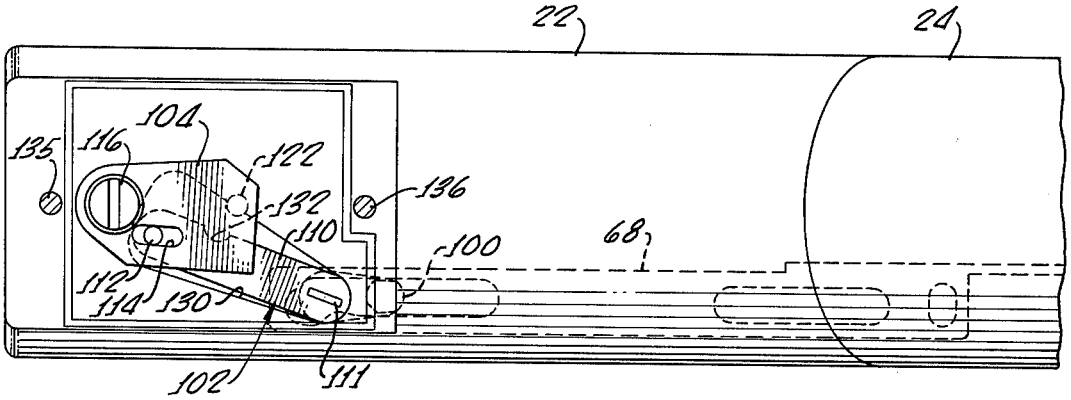
FIGS. 7 and 8 are fragmentary views of the initiator with a portion of the top housing removed, showing the sear and trigger mechanism is precocked and cocked position, respectively.

The inactive position of FIG. 11 is also illustrated in the fragmentary view of FIG. 7 which shows primary lever 102 in a relatively counter-clockwise position within its recess 130 and the secondary lever 104 overlying the aneroid actuator pin 122.

To operate the device, cable 32 is pulled, requiring, in exemplary embodiment, a cocking tensile force of approximately 15 to 35 pounds which is sufficient to compress spring 44. When a cocking tensile force is exerted upon the cable 32, the hammer is drawn back, toward the right in FIG. 11, until the interengaging cams 52, 54 clear the end of housing section 24 whereby the restraint upon the camming disengagement of these elements is released. Accordingly, cocking pin 50 is disconnected from hammer shaft 42. As the hammer moves from its precocked position of FIG. 11 to its cocked position of FIG. 12, engagement of the sear drive tongue 64 in aperture 66 of the sear plate drives the sear rearwardly in the linear guiding slot of the mechanism housing. As the sear approaches its cocked or latched position, angulated portion 98 of its cam slot engages cam pin 100 to shift the primary lever 102 in a clockwise direction about the axis of its shaft 106, thereby causing connecting pin 112 to drive secondary lever 104 from its inactive position in a counter-clockwise direction about the axis of its pivot 116 until an edge 146 on the near side of lever 104 (as viewed in FIG. 12) clears the path of motion of aneroid pin 122. Now, if the ambient pressure is below a predetermined value, the pin 122 will project axially upwardly into the path of rotational motion of secondary lever 104. Thus, in the position illustrated in FIG. 12, pin 122 lies in the path of clockwise motion of secondary lever 104, which motion is thus restrained by the pin.

In the cocked position of FIG. 12, spring 44 is compressed between the end wall of housing section 24 and the head 40 of the hammer, urging the hammer from the cocked position toward the cartridge 80. Such firing motion of the hammer from its cocked position is restrained by interengagement of tongue 64 with sear 68. The latter, in turn is restrained against axial sliding motion toward the left as viewed in FIG. 12 by interengagement of the cam pin 100 with the angulated cam slot 98.

That motion of the sear (toward the left in FIG. 12) which is urged by the compressed spring tends to act through the interengaging cam pin 100 and cam slot portion 98 to rotate primary trigger 102 in a counter-clockwise direction about the axis of its shaft 106. However, such counter-clockwise motion of the primary lever is restrained by its interengagement with the secondary lever 104 which, in turn, is restrained by the aneroid pin 122 when ambient pressure is below a preset value.

Figure 8:
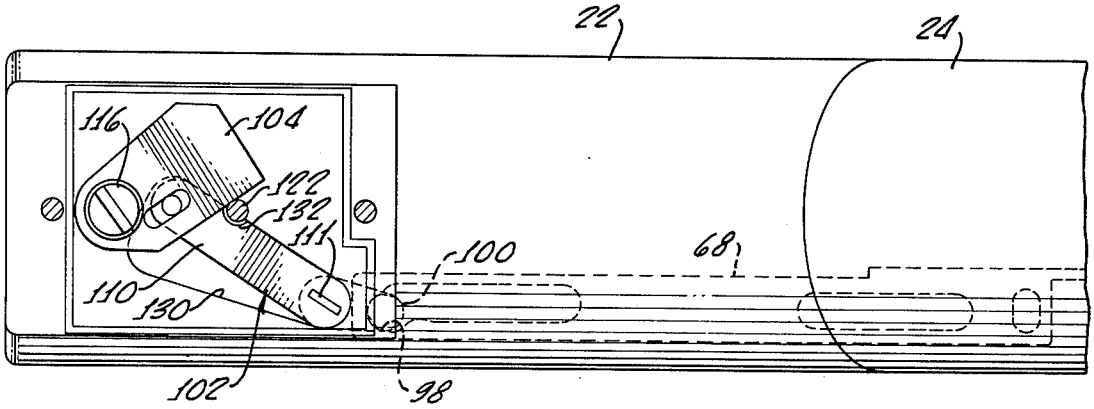

The cocked position of FIG. 12 is also illustrated in FIG. 8, which shows primary lever 102 in its extreme clockwise position, secondary lever 104 in an extreme counter-clockwise position and cam pin 100 engaged in the angulated portion 98 of cam slot 96.

As the apparatus descends to an altitude wherein the ambient pressure is below a preset value, pin 122 is retracted thereby releasing its restraint upon the secondary trigger 104. The latter being free to rotate in a clockwise direction, now releases its restraint upon primary trigger 102 which accordingly is now free to rotate in a counter-clockwise direction, in which direction it is urged by the sear 68, via the hammer 40 and compressed spring 44. Accordingly, upon withdrawal of the pin 122 from the path of motion of the secondary lever 104, the hammer is driven to the cartridge by the compressed spring 44 and thereafter assumes the fired position of FIG. 13.

As the firing pin strikes the cartridge, detonation begins and, after a suitable delay, gases of combustion flow through conduit 87 to the cylinder 88 and thereby drive the actuator piston forceably to the right as viewed in FIG. 12, pulling cable 28 through a forced actuating stroke having a length equal to the distance travelled by piston 90, between the positions illustrated in FIGS. 12 and 13.

As the trigger mechanism is freed of control of the now withdrawn aneroid pin 122, cam pin 100 moves into the main body portion of cam slot 96 and the sear slides forwardly with the hammer while cam pin 100 rides rearwardly along the cam slot 96 which accordingly forms a lost motion connection that allows relative motion of cam pin and cam slot in either direction from the precocked position without effect upon any of the other parts.

If operation of the device is commanded by pulling the operating cable 32 when the apparatus is below a preset altitude (when ambient pressure is above a predetermined value), aneroid pin 122 is in a retracted position and does not project into the path of motion of secondary lever 104. Accordingly, as the device is cocked and the sear is moved to its latch position as shown in FIG. 12, there is no restraint upon the trigger mechanism when it moves to its active position and spring 44 will immediately drive the hammer 40 to detonate the cartridge.

The major sub-assemblies of the described initiator, as particularly illustrated in FIGS. 9 and 10, are readily assembled and disassembled, thus simplifying manufacture, repair and testing. The apparatus is normally in a precocked position and accordingly, needs no safety devices such as are normally employed in an explosive device carried about in a cocked condition. This feature, together with the ready assembly and disassembly of housing sections, readily allows test firing of the device and reuse of the device after it has been fired. To reload after firing in actual operation or test, housing section 26 is removed by removing the screws connecting it to the two sections 22 and 24. The subassembly of actuator piston and cylinder together with the cable 19 and sheath 16 are removed, the cartridge is replaced and the trigger mechanism and sear are moved to inactive position. The hammer is manually drawn back against the action of the spring to allow the cams 52, 54 to be manually engaged and the spring then pulls the interengaged cams into the sleeve 48 until cocking pin 50 seats against the end of housing section 24. Sear plate 68 is then slidably positioned until aperture 66 is aligned to receive tongue 64 as the housing sections 22 and 24 are interengaged with each other by radially sliding the breach plate 79 into the semi-circular groove 83 of housing 22. The piston and cylinder actuator assembly is now placed in the half of the circular cylindrical recess formed in housing sections 22 and 24. Housing section 26 is then screwed to both of the sections 22 and 24, whereupon the device is ready to be operated or tested again. In a preferred embodiment, the housing and most of the mechanism are made of parts that are relatively simply machined, although many of the parts may be readily cast if deemed necessary of desirable.

There has been described a simplified, compact arrangement for a controlled actuator having relatively few moving parts. The arrangement includes a unique active and inactive relation between an aneroid device and a trigger mechanism controlled thereby wherein none of the elements are directly connected with the aneroid and no undue restraint is imposed thereon prior to cocking of the device. The mechanism is normally uncocked, with its driving spring unstressed, thus providing considerably enhanced safety in that a cocked and armed explosive need not be carried around in an aircraft for an indefinite period of time. The apparatus is inexpensive, simple and readily assembled. It can be tested after assembly and readily reassembled for use since no frangible safety devices or shear pins are employed or necessary in this normally uncocked device.

The foregoing description is to be clearly understood as being give by way of illustration only, the spirit and scope of the invention being limited solely by the appended claims.

We claim:

1. In an explosive initiator having a spring driven hammer for detonating a cartridge, a cocking mechanism for cocking the hammer and compressing the spring, and means for releasing the cocking mechanism to permit the spring to drive the hammer toward the cartridge, the improvement comprising a pressure sensitive control for the hammer, said control including a pressure sensitive device, a slidably mounted sear connected to the hammer for motion therewith to a latch position as the hammer moves toward a cocked position, and including means for restraining motion of the hammer toward said cartridge when the sear is in said latch position, and trigger means interposed between said device and said sear and operable under control of said device for restraining motion of said sear from said sear latch position.

2. The initiator of claim 1 wherein said trigger means for restraining motion of said sear comprises a normally inactive trigger mechanism, and including means responsive to motion of the sear to said latch position for activating said trigger mechanism.

3. The initiator of claim 2 wherein said pressure sensitive device includes an axially movable control pin, and wherein said trigger mechanism includes a lever overlying said control pin in said inactive position, said lever being movable in response to motion of said sear to said latch position to a position laterally displaced from said control pin.

4. The initiator of claim 1 wherein said sear comprises a slidably mounted elongated element having one end thereof connected to said hammer, and wherein said trigger means comprises a pivotally mounted lever and interengaging cam means on said sear and lever for driving said lever in a first direction as said sear moves toward said latch position and for urging said lever in an opposite direction as said sear is urged from said latch position and said hammer is urged from said cocked position toward said cartridge.

5. The initiator of claim 4 wherein said trigger means comprises a second pivotally mounted lever connected with said first lever for motion along a path between a first inactive position and a second active position, said pressure sensitive device comprising an axially movable control pin positioned outside of the path of motion of said second lever when the second lever is in said inactive position and adapted to extend into and be withdrawn from said path when the second lever is in said operable position.

6. An aneroid controlled initiator comprising:

a housing having a cartridge chamber formed therein, a hammer movably mounted in the housing for motion from a precocked position to a cocked position and thence to a firing position with respect to a cartridge in said chamber, a firing spring engaging the hammer and adapted to be compressed as the hammer moves to said cocked position and compressing said spring, releasable means for moving the hammer to said cocked position, an elongated sear slidably mounted in said housing, means connecting said sear to the hammer for motion therewith between a precocked sear position and a cocked sear position, an aneroid device mounted in said housing, a trigger mechanism connected to be controlled by said aneroid device, and a lost motion connection between said sear and said trigger mechanism.

7. The initiator of claim 6 wherein said cartridge chamber is interposed between said trigger mechanism and said hammer, and wherein said elongated sear extends along said cartridge chamber from said hammer to said trigger mechanism.

8. The initiator of claim 6, wherein said hammer is mounted at one end of said housing, said aneroid device and trigger mechanism are mounted at the other end of said housing, said cartridge chamber is interposed between said hammer and said aneroid device, and said elongated sear extends along said chamber from said hammer to said trigger mechanism.

9. The initiator of claim 8 including an actuator cylinder in said housing, an actuator piston slidably mounted in said cylinder, and passage means for flowing gas from said cartridge chamber into said cylinder at one side of said piston to thereby forcibly drive said piston upon detonation of a cartridge in said chamber.

10. The initiator of claim 6 wherein said trigger mechanism includes a first lever mounted for motion in a first direction, wherein said aneroid device includes means for restraining motion of said lever in said first direction in response to a preselected pressure, and wherein said lost motion connection comprises means on said lever for restraining motion of said slidable sear from said cocked sear position as long as motion of said lever in said first direction is restrained by said aneroid device.

11. The initiator of claim 6 wherein said aneroid device includes a control pin movable through a path in a first direction, wherein said trigger mechanism includes a first lever pivotally mounted to said housing and having first and second arms, a cam carried by said first arm, said sear having a cam slot formed therein and receiving said cam, said mechanism further including a second lever pivotally mounted to said housing for motion about an axis parallel to said first direction, said second lever having an arm extending through said path of said control pin in a first position of said second lever and being movable to a second position wherein said control pin can extend into the path of motion of said second lever arm, and a bidirectional driving connection between said second lever and the second arm of said first lever.

12. A controlled actuator comprising a first housing section having a cartridge chamber formed therein, a second housing section having a hammer recess formed therein, a hammer mounted in said hammer recess, spring means for driving said hammer mounted in said second housing section, said first and second housing sections having interengaging and mating end surfaces including means carried by said second housing section for closing the cartridge chamber formed in said first housing section, a third housing section extending along both of said first and second housing sections and fixedly connected to both of said first and second sections, all of said housing sections collectively defining an actuator cylinder recess extending longitudinally of said housing sections, an actuator cylinder and piston assembly mounted in said actuator cylinder recess, and conduit means for providing fluid communication between said actuator cylinder and said cartridge chamber.

13. The apparatus of claim 12 including a sear guideway formed in said first housing section, an elongated sear slidably mounted in said guideway, a sear drive arm fixed to said hammer and connected with said sear, an aneroid device mounted in an end of said first housing section remote from said cartridge chamber, trigger means interconnected between said sear and said aneroid device, and means for cocking the hammer to compress said spring means.

* * * * *